US005083160A

United States Patent [19]

Suzuki et al.

[11] Patent Number: 5,083,160

[45] Date of Patent: Jan. 21, 1992

[54] IMAGE DENSITY CONTROL METHOD AND COLOR IMAGE FORMING APPARATUS

[75] Inventors: Kohji Suzuki, Yokohama; Masao Masumura, Tokyo; Hajime Oyama, Ichikawa; Shinichi Namekata, Yokohama, all of Japan

[73] Assignee: Ricoh Company, Ltd., Tokyo, Japan

[21] Appl. No.: 626,334

[22] Filed: Dec. 13, 1990

Related U.S. Application Data

[63] Continuation of Ser. No. 289,253, Dec. 23, 1988, abandoned.

[30] Foreign Application Priority Data

Dec. 25, 1987 [JP] Japan ..... 62-329023
Dec. 25, 1987 [JP] Japan ..... 62-329024

[51] Int. Cl.[5] ..... G03G 15/01; G03G 15/08

[52] U.S. Cl. ..... 355/208; 355/214; 355/246; 355/327

[58] Field of Search ..... 355/208, 214, 246, 326–327; 430/30, 42–44

[56] References Cited

U.S. PATENT DOCUMENTS

| | | | |
|---|---|---|---|
| 2,956,487 | 10/1960 | Giaimo | 355/261 |
| 4,277,162 | 7/1981 | Kasahara et al. | 355/208 |
| 4,318,610 | 3/1982 | Grace | 355/246 |
| 4,348,099 | 9/1982 | Fantozzi | 355/208 |
| 4,377,338 | 3/1983 | Ernst | 355/246 |
| 4,468,112 | 8/1984 | Suzuki et al. | 355/246 |
| 4,519,695 | 5/1985 | Murai et al. | 355/246 |
| 4,572,654 | 2/1986 | Murai et al. | 355/214 |

FOREIGN PATENT DOCUMENTS

| | | | |
|---|---|---|---|
| 3242384 | 4/1986 | Fed. Rep. of Germany . | |
| 60-57869 | 4/1985 | Japan | 355/326 |
| 60-80865 | 5/1985 | Japan . | |
| 63-92967 | 4/1988 | Japan | 355/327 |
| 1559341 | 1/1980 | United Kingdom | 355/246 |

*Primary Examiner*—Joan H. Pendegrass
*Attorney, Agent, or Firm*—Oblon, Spivak, McClelland, Maier & Neustadt

[57] ABSTRACT

An image density control method and a color image forming apparatus for controlling the density of a multicolor image to be reproduced, having functions of forming for each color a first reference latent image, to be developed in a medium density, on a latent image carrying member, forming for each color a second reference latent image, to be developed in a low density, on the latent image carrying member, depositing toner of a color corresponding to each of the first and second reference latent images on respective of the first and second reference latent images, sensing the quantities of different by colored toners deposited on respective of the first and a second reference latent images for each color and controlling, at least one image forming condition in the formation of images of each color to correct the density of the medium toner density portion of the image for toner color on the basis of the sensed results.

6 Claims, 10 Drawing Sheets

IMAGE DENSITY CONTROL METHOD AND COLOR IMAGE FORMING APPARATUS

This application is a continuation of application Ser. No. 07/289,253, filed on Dec. 23, 1988, now abandoned.

BACKGROUND OF THE INVENTION

1. Field of the Invention

The present invention relates to an image density control method and a color image forming apparatus such as a color copying machine. More particularly, the present invention relates to an apparatus which develops latent images formed for different colors by using corresponding color toners under predetermined conditions, and superposes the resultant different color toner images to form a single color image, and to an image density control method performed by the apparatus.

2. Description of the Related Art

A color image forming device such as a color reproduction machine usually includes a latent image carrying member such as a photosensitive drum on which latent images for the respective colors of an image to be finally formed are formed and respective developing devices which are disposed close to the latent image carrying member and use corresponding color toners. The latent images for corresponding colors are developed by the corresponding color developing devices under predetermined conditions to be formed into corresponding color toner images, and these color toner images are finally superposed to form a color image.

There are two known methods of controlling the respective density of the different color images in a color image forming device of this type:

(1) One method is to sense the surface potential of the latent image carrying member using a surface potential meter, to correct the surface potential to a constant value and to maintain it at that constant potential (Published Unexamined Japanese Patent Application (Kokai) Nos. 57-100,448, 57-163,241, 57-163,242 and 58-217,960), and (2) The other method is to deposit a toner on the surface of a latent image carrying member or on a developing capability sensor provided in the developing device, to irradiate light onto the deposited toner layer, to sense the reflection to determine the developing capability and to control the toner density such that the developing capability becomes constant (Published Unexamined Japanese Patent Application (Kokai) Nos. 60-73,655 and Published Unexamined Japanese Utility Model Application (Jikkai) No. 55-162,253).

However, according to the above methods, finally, only the density of a high density portion of a color image can be controlled and it is impossible to cope with a possible loss of the color balance in the medium or low density portion of the color image where color changes are most likely to appear.

Solely by correcting and maintaining the surface potential at a constant value, it is impossible to cope with fluctuations of the developing capability due to the supply of an excessive quantity of toner. As a result, the toner density may abnormally increase thereby to create smears in the low image density portions (high light portions).

Especially the copy density versus original document density characteristics of toner colors are different from each other and fluctuate depending on the state of toners used and on environmental fluctuations. Furthermore, developing capabilities such as the quantity of electric toner charges also fluctuate depending on aging and environmental fluctuations. Therefore, it is difficult to obtain a stabilized color balance.

SUMMARY OF THE INVENTION

It is therefore an object of the present invention to provide a color image forming apparatus and an image density control method which is capable of providing an image having a stabilized satisfactory color balance in every color density.

Another object of the present invention is to provide a color image forming apparatus and an image density color method which is capable of preventing creation of an abnormal image due to environmental changes.

These and other objects are achieved according to the present invention by providing a novel method and apparatus for controlling the density of a multi-color image to be reproduced, wherein, for at least one color and preferably for all colors, the following functions are performed: forming a first reference latent image, to be developed in a medium density, on a latent image carrying member; forming a second reference latent image, to be developed in a low density, on the latent image carrying member; depositing toner of the respective color on the respective first and second reference latent images; sensing the quantity of toner deposited on the respective first and a second reference latent images for each respective color; and controlling at least one image forming condition on the basis of the sensed results thereby to correct for the respective color the density of the medium density portion of the image to be reproduced.

The controlling function may include a function of calculating a ratio of the sensed quantity of toner deposited on the first reference latent image to the sensed quantity of toner deposited on the second reference latent image for the respective toner color, and a function of controlling the at least one image forming condition on the basis of the calculated ratio.

The controlling function may include function of controlling the image forming conditions on the basis of the result of the comparison of the calculated ratio and a reference value, and preferably includes a function of controlling the voltage of an exposure power source on the basis of the result of the comparison to correct the density of the medium density portion of the image to be reproduced for the respective toner color.

It is desired further to include a function of controlling the density of the low density portions of the image for each toner color by controlling at least one image forming condition on the basis of the sensed quantity of toner deposited on the second reference toner image, in particular by controlling the at least one image forming condition on the basis of the result of comparison between a reference value and the sensed quantity of toner deposited on the second reference toner image. The controlling function preferably includes a function of controlling the developing bias voltage during development of the respective color on the basis of the result of the comparison.

The function of forming a first reference latent image on a latent image carrying member preferably includes exposing to light a medium density pattern provided beforehand.

The function of forming a second reference latent image on a latent image carrying member preferably includes exposing to light a low density pattern provided beforehand.

Alternatively, the function of forming a first reference latent image on the latent image carrying member includes directly controlling the potential of electric charges on the latent image carrying member, and the function of forming a second reference latent image on the latent image carrying member includes directly controlling the potential of electric charges on the latent image carrying member.

It is preferable to have further functions of sensing the toner density of a developer for each toner color, and controlling the image forming conditions for each color on the basis of the sensed toner density to correct, for each color, the density of a high density portion of the image to be reproduced. The function of controlling the density of the high density portion of the image preferably includes controlling at least one image forming condition on the basis of the result of comparison between the sensed toner density and a reference value, in particular by controlling a supplemented quantity of toner on the basis of the result of the comparison.

It is desired to have a function of controlling the density of the high density portions of the image to be reproduced, preferably for each color, by controlling at least one image forming condition on the basis of the result comparison between the sensed toner density and a reference value, and of correcting the reference value on the basis of the sensed quantity of toner deposited on the first and second toner images.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
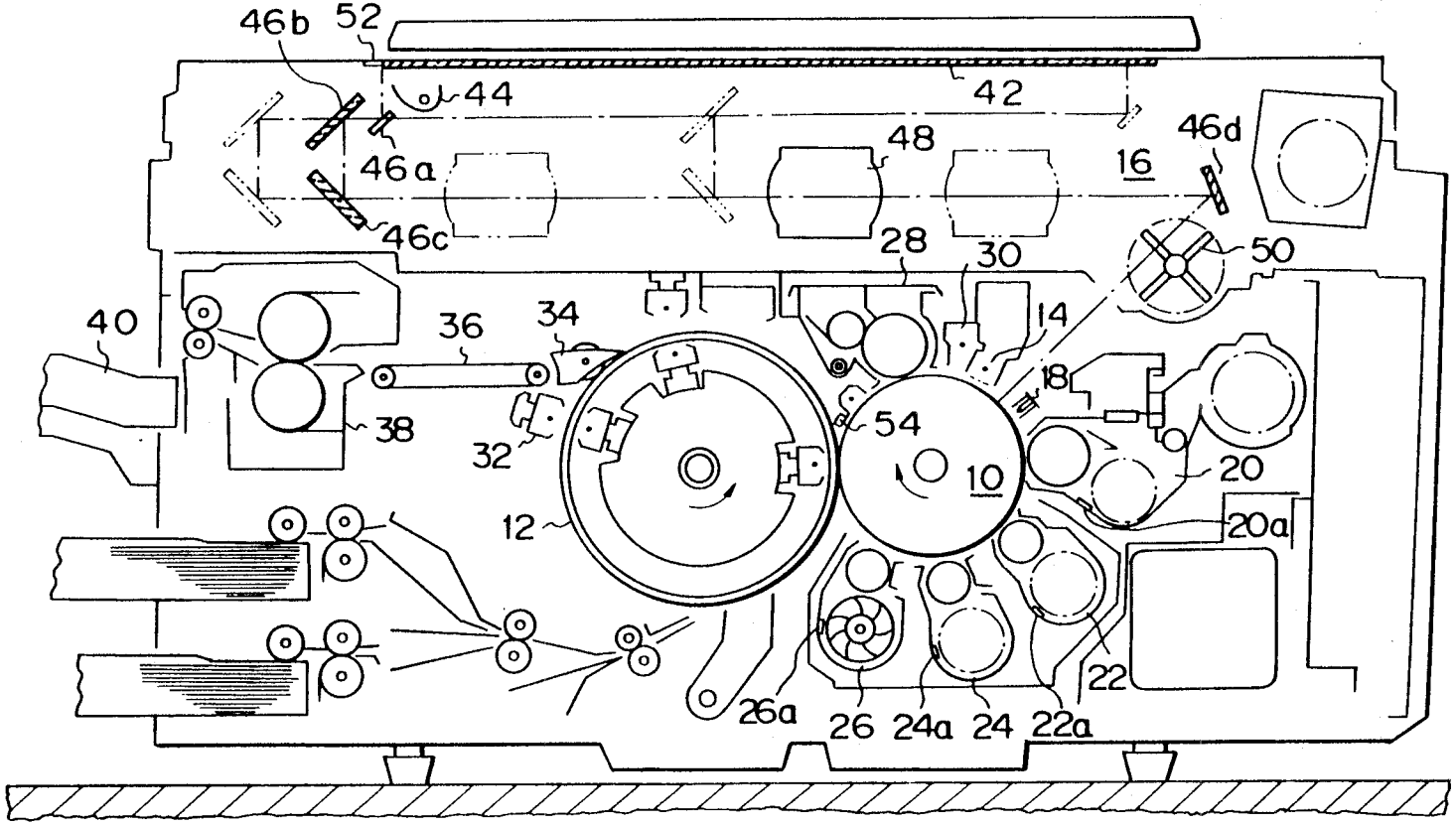
FIG. 1 schematically shows the mechanical structure of a color copying machine as one embodiment of the present invention.

Referring now to the drawings, wherein like reference numerals designate identical or corresponding parts throughout the several views, FIG. 1 illustrates the mechanical structure of a color copying machine as an embodiment of the present invention. Disposed in order at substantially the center of the copying machine are a photosensitive drum 10 which can carry a latent image thereon and a transfer drum 12 which transfers a toner image derived by development of a latent image on the photo-sensitive drum 10. Disposed around the photosensitive drum 10 capable of rotating in the direction of the arrow are an electrostatic charger 14 which initially charges uniformly the surface of the photosensitive drum 10, an exposing optical system 16 which exposes the uniformly charged surface of the photosensitive drum 10 to an optical image of an original document to form an electrostatic latent image, and an eraser 18 which irradiates light onto the photosensitive drum 10 except for the image area and for a density detection pattern to be described later in more detail so as to eliminate the remaining electric charges from the drum 10. Furthermore, disposed around the drum 10 are black (BK), yellow (Y), magenta (M) and cyan (C) toner developing devices 20, 22, 24 and 26 which supply respective toners to the latent images for developing the images to form respective color toner images, the aforementioned transfer drum 12 which can hold a recording sheet paper for transferring different color toner images sequentially onto the recording sheet, a cleaner device 28 which cleans the remaining toners on the drum surface after transfer, and a discharger 30 which eliminates the remaining charges on the drum 10 after transfer. The transfer drum 12 has a separating charger 32 and a pickoff finger 34 which cooperate to separate the transferred recording paper from the transfer drum 12. A fusing device 38 is disposed at an end of a carrier belt 36 which carries the recording paper separated from the transfer drum 12 in order to fuse, press and fix the toner image to the recording paper. A discharged paper tray 40 is provided at the exit of the fusing device 38. The exposing optical system 16 further includes a contact glass plate 42 disposed on the top of the copying machine for receiving an original document thereon, an exposure lamp 44 which irradiates scanning light onto the original document on the contact glass 42, reflective mirrors 46*a*, 46*b*, 46*c* and 46*d* and a focusing lens 48 which focuses the reflected light from the original document via the reflective mirrors onto the photosensitive drum 10, and a color separation filter 50 which separates the optical image into color images.

A density sensing pattern 52 described in detail later is provided near one end of the contact glass plate 42. A photoelectric sensor 54 is provided behind the transfer drum 12 around the photosensitive drum 10 in order to sense a deposited quantity of toner on a toner image of the density sensing pattern, formed on the photosensitive drum 10. Permeability sensors 20*a*, 22*a*, 24*a* and 26*a*, described in more detail hereinafter, are disposed in the developing devices 20, 22, 24 and 26, respectively, in order to sense the toner densities on the basis of changes in the permeabilities of the respective developers.

Figure 2:
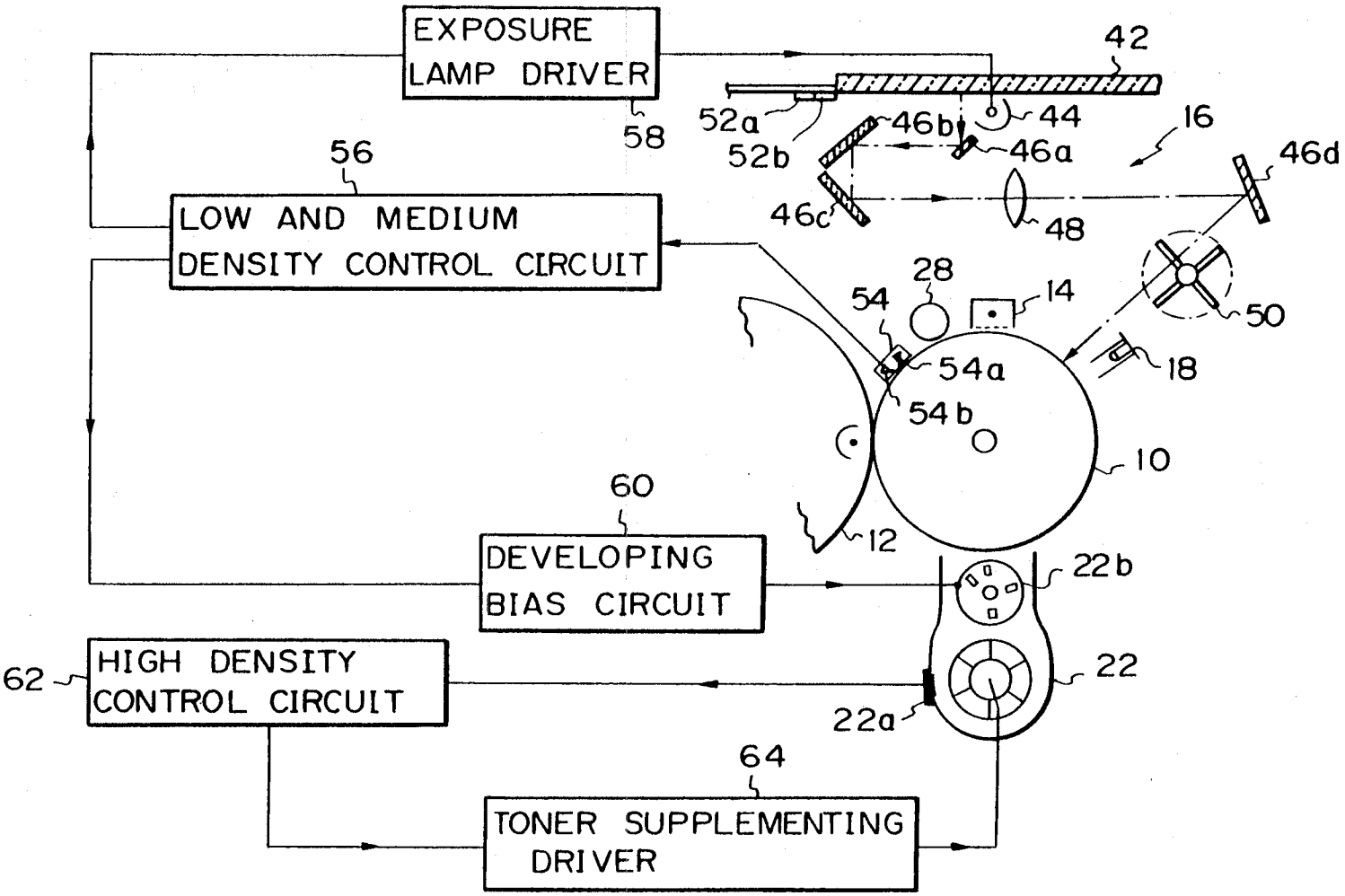
FIG. 2 schematically illustrates one example of an image density control system in the embodiment of FIG. 1.

FIG. 2 schematically illustrates one example of an image density control system in the embodiment of FIG. 1. The image density control to be described below are performed actually for each of colors, namely, black, yellow, magenta and cyan. For purpose of explanation, herein, control of the density of a yellow image will be described. In the embodiment, a medium density pattern 52*a* having a density of from 0.3 to 0.4 and a low density pattern 52*b* of white background are provided as the density patterns 52 outside the image area (contact glass plate 42). These density patterns are exposed by means of the optical system 16 onto the photosensitive drum 10 to thereby form corresponding latent images thereon. The respective formed latent images are developed by the yellow toner into toner images each having a respective one of a medium and a low density patterns. The respective deposited quantities of yellow toner are sensed by the photoelectric sensor 54.

The sensor 54 includes a light emitting element 54*a* made, for example, of a light emitting diode and a photodetector 54*b* made, for example, of a photodiode so that the light emitted from the element 54*a* is reflected by the toner image and detected by the photodetector 54*b* thereby to detect the respective deposited quantities of the toner.

A detection signal derived based on each of the density patterns from the photoelectric sensor 54 is applied to a low and medium density control circuit 56 which has two functions. One is to provide a control value of a voltage applied to the exposure lamp 44 in order to control the medium density of the image, and the other is to provide a control value of the developing bias voltage in order to control the density of the low density portion of the image.

In order to provide the former function, the control circuit 56 includes means for storing the values of detection signals on the deposited toner quantities on the low and medium density pattern images, means for calculating the ratio of the stored values, means for comparing a reference value and the value of the ratio obtained by the calculation, and means for determining control value of the voltage applied to the exposure lamp 44 in accordance with the result provided by the comparing means. The signal representative of the determined control value is sent to an exposure lamp driver 58 to control the voltage applied to the exposure lamp 44 in accordance with that signal.

The control circuit 56 for providing the latter function includes means for comparing a reference value and the stored value on the detection signal indicative of the quantity of toner deposited on the low density pattern image, and means for determining a control value of the developing bias voltage in accordance with the value provided by the comparing means. The signal representative of the determined control value is sent to a developing bias circuit 60 to control the bias voltage applied to a developing roller 22*b* in the developing device 22 in accordance with that signal.

The permeability sensor 22*a* is a well-known type wherein a developer including toner with magnetic carriers is guided through a coil of a resonant circuit, and that the toner density is sensed by sensing a change in the inductance according to the relative quantity of magnetic carriers relative to the toner in the developer.

The detection signal from the permeability sensor 22*a* is applied to a high density control circuit 62 which has a function of determining whether the toner should be supplemented to correct the high density portion of the image. In order to provide such function, the control circuit 62 includes means for comparing a signal from the permeability sensor 22*a* with a reference to determine whether the toner density is below the reference value. The output from the comparing means is supplied to a toner supplementing driver 64 to control the drive of a toner supplementing mechanism (not shown) in the developing device 22.

The operation of the embodiment will now be described. A process for forming a color image in the embodiment includes the repetition of the steps of (a) electrical charging of the photosensitive drum 10, (b) color separation and exposure on the .photosensitive drum 10, (c) development by toners and (d) transfer onto recording paper on the transfer drum 12, for each black, yellow, magenta and cyan color toner. Then, the superposed toner images of four colors are at one time fused and fixed at the fusing device 38 to form a color image finally.

At the exposure stage of each cycle, the medium and low density patterns 52*a* and 52*b* are exposed outside the image area on the photosensitive drum 10 thereby to form latent images having the corresponding potentials thereon. These latent images are developed by the color toners during each repetition of the steps for forming a color image, above described, into corresponding density i.e., medium and low, toner images. The quantities of toners deposited on those toner images are sensed by the photoelectric sensor 54. As mentioned above, the voltage applied to the exposure lamp 44 and hence the quantity of exposure are controlled in accordance with the sensed quantities of the toner so that the density of the medium density portion of the image is controlled to a proper value. This control is performed for each repetition cycle, namely, for each toner color.

If fluctuations occur in the medium density of the image, a large change would occur in the color, and color unbalance would occur very noticeably. However, in this embodiment, as mentioned above, a system technique is employed in which a deposited toner quantity of medium density and of low density is sensed by the photoelectric sensor 54 to control the optical exposure system with a high degree of responsiveness. Thus, density correction is rapidly performed thereby to suppress to a minimum possible unbalance of the color density.

The density of the low density, namely background density, of the image is controlled by controlling the developing bias, as mentioned above, in accordance with the quantity of a toner deposited on the image of the low density pattern as sensed by the photoelectric sensor 54. This control is performed for each color. The developing bias voltage is corrected in accordance with fluctuations of the potential of the background, and hence of the deposited low density toner quantity caused by the aging of the photosensitive drum 10 due to its fatigue. Thus the density of the low density portions of the image is properly corrected and smears in the background of the image are eliminated.

While fluctuations of the density of the low density portion of the image greatly influence the color balance, the developing bias control which is of high control responsiveness is effected in this embodiment. Therefore, density correction is rapidly performed and color unbalance is suppressed to a minimum.

The respective toner densities are controlled in accordance with the outputs from the permeability sensors 20*a*, 22*a*, 24*a* and 26*a* of the corresponding developing devices 20, 22, 24 and 26, as mentioned above. As a result, the respective color toner densities in the developing devices are corrected and controlled to corresponding predetermined values even if they may fluctuate, and the density of the high density portions of the image is properly adjusted. The high density portions of the image are different from the medium and low density portions of the image in that no large color fluctuations occur due to second and third colors even if a particular color may slightly be thinned. Thus a satisfactory color balance is maintained even by toner density control having a relatively low control responsiveness, as mentioned above.

Figure 3:
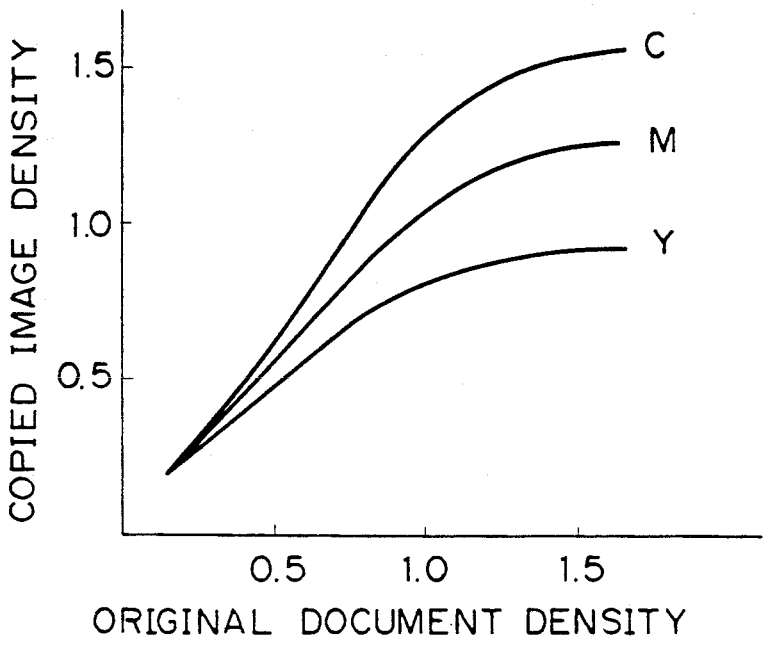
FIG. 3 is a characteristic diagram representing the relationship between original document density and copied image density.
Figure 4:
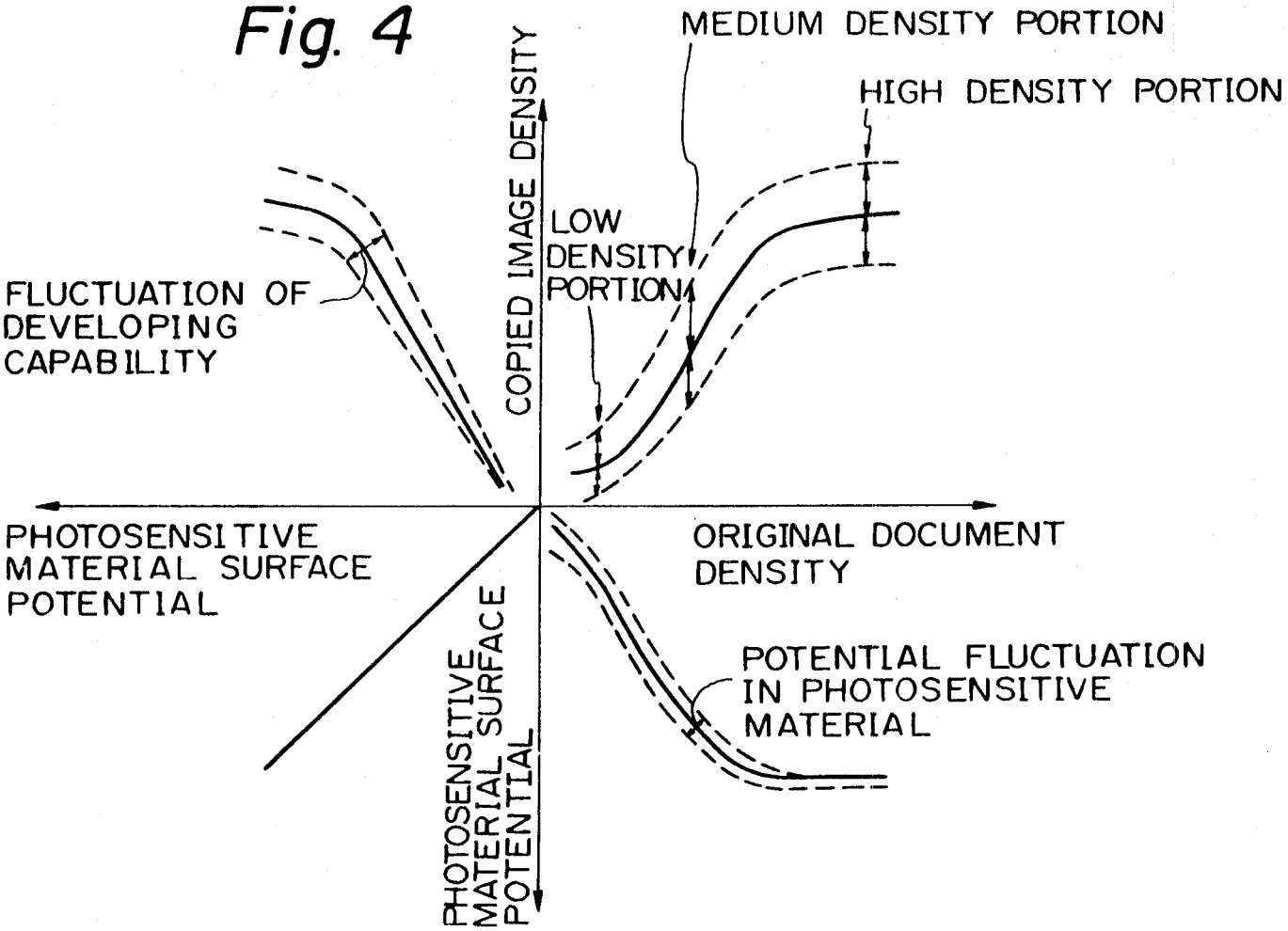
FIG. 4 is a four-quadrant chart representing fluctuations of copied image density versus developing capability and fluctuations of the sensitivity of a photo-sensitive material.

FIG. 3 shows the original document density versus copied image density characteristic for each toner color (C, M or Y) obtained when color balance is maintained. As will be seen in FIG. 3, it is necessary to satisfy different characteristics of the respective toner color densities of the image in order to achieve a satisfactory color balance. As shown in the first quadrant of FIG. 4, the original document density copied image density characteristic will change in accordance with fluctuation of developing capability (second quadrant) such as toner density and a quantity of electric toner charges, and potential fluctuation in a photosensitive material (fourth quadrant). Therefore, as in the embodiment, a satisfactory color balance can not be maintained until the respective densities of the low, medium and high density portions of the image for each color are controlled. In this case, density fluctuations of the medium density portions of the image are likely to be noticeable, so that as in the embodiment, rapid correction and control are required for each color.

Figure 5:
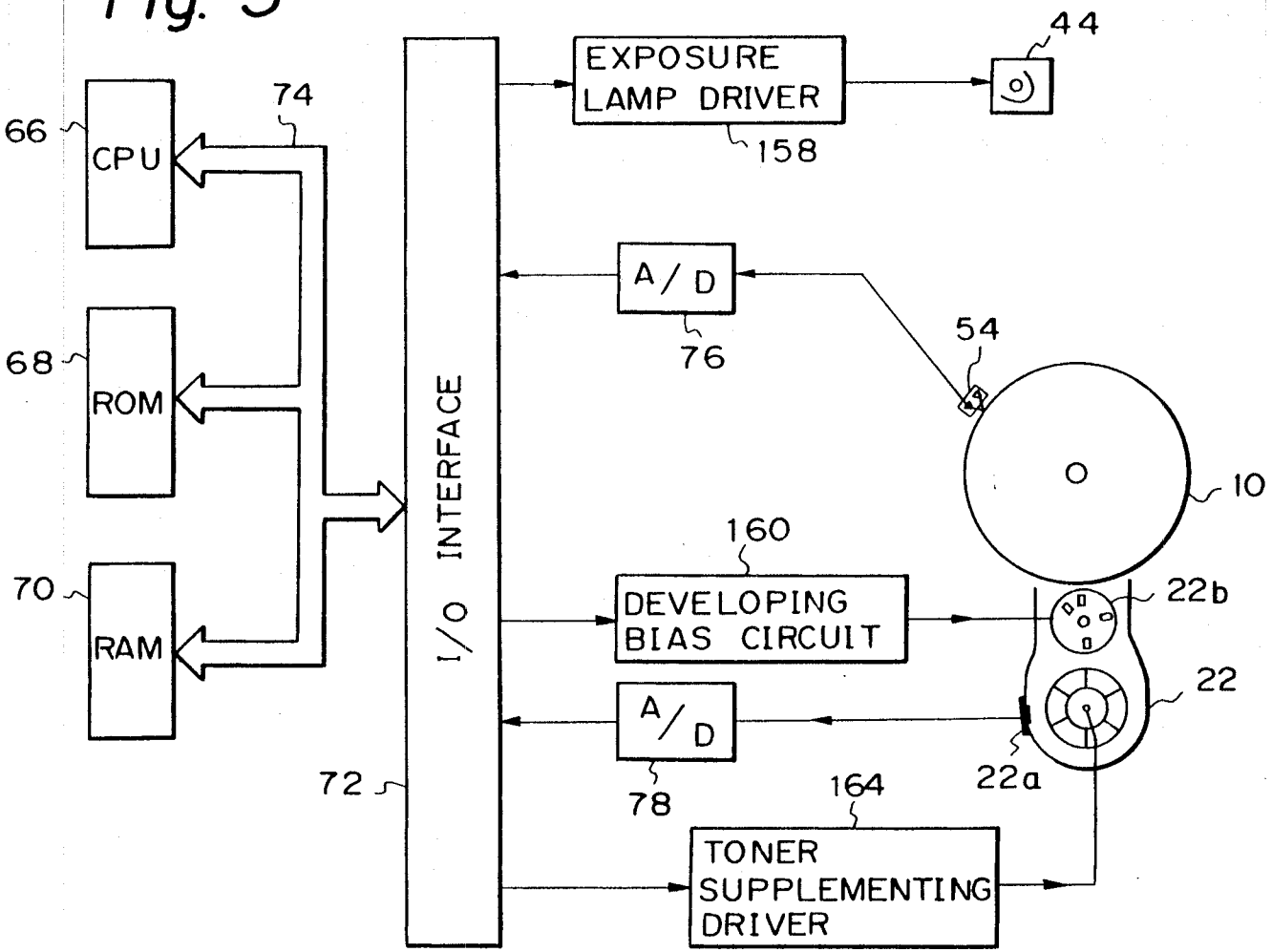
FIG. 5 schematically illustrates one example of an image density control system in another embodiment of the present invention.

FIG. 5 schematically illustrates one example of an image density control system of another embodiment of the present invention. This embodiment is the same in structure as the embodiment of FIGS. 1 and 2 except for the image density control system.

In this embodiment, the image density control system includes a microcomputer which basically comprises a central processing unit (CPU) 66, a read only memory (ROM) 68, a random access memory (RAM) 70, an input/output (I/O) interface 72 and a bus 74 connecting these elements. The microcomputer has the same functions as the low and medium density control circuit 56 and the high density control circuit 62 of FIG. 2.

The analog detection signals from the photoelectric sensor 54 and permeability sensor 22*a* are converted by analog-to-digital (A/D) converters 76 and 78, respectively, to the corresponding digital signals for use in the microcomputer. The resulting digital signals are applied to the I/O interface 72. The output detection signals from other permeability sensors 20*a*, 24*a* and 26*a* are input to the I/O interface 72 through other A/D converters (not shown). Exposure lamp driver 158, developing bias circuit 160 and toner supplementing driver 164 are the same in function as the exposure lamp driver 58, developing bias circuit 60 and toner supplementing driver 64, respectively, in FIG. 2 except that they are driven by the digital signals from the I/O interface 74.

FIGS. 6, 8, 9 and 10 schematically illustrate control programs for the microcomputer of FIG. 5. The operation of this embodiment will now be described using these flowcharts.

Figure 6:
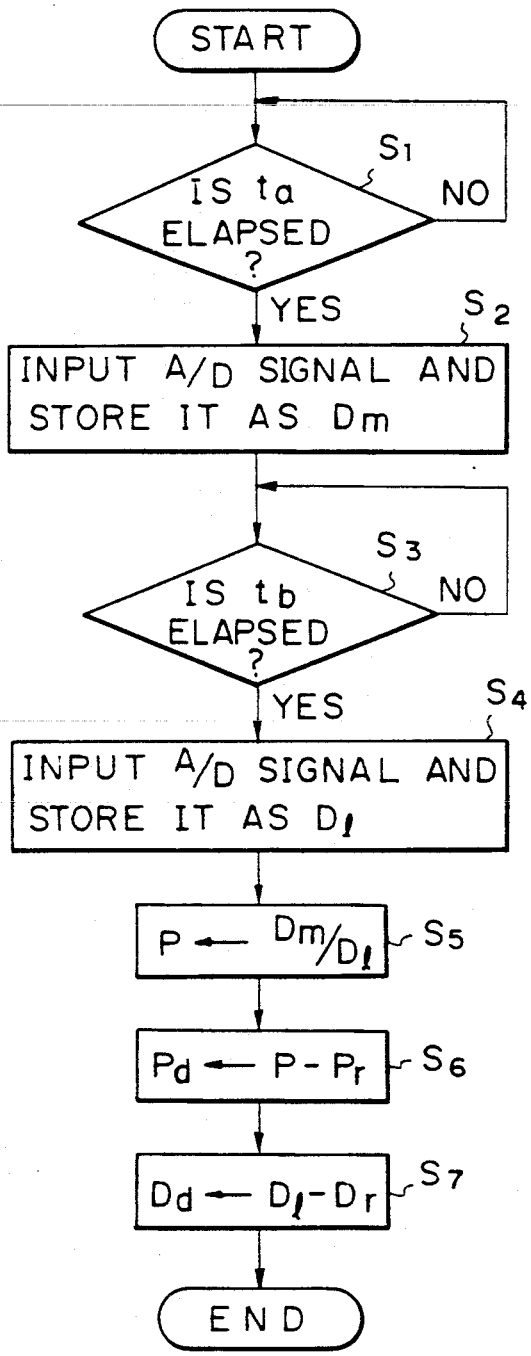
FIG. 6 is a flowchart showing part of a micro-computer control program used in the embodiment cf FIG. 5.
Figure 7:
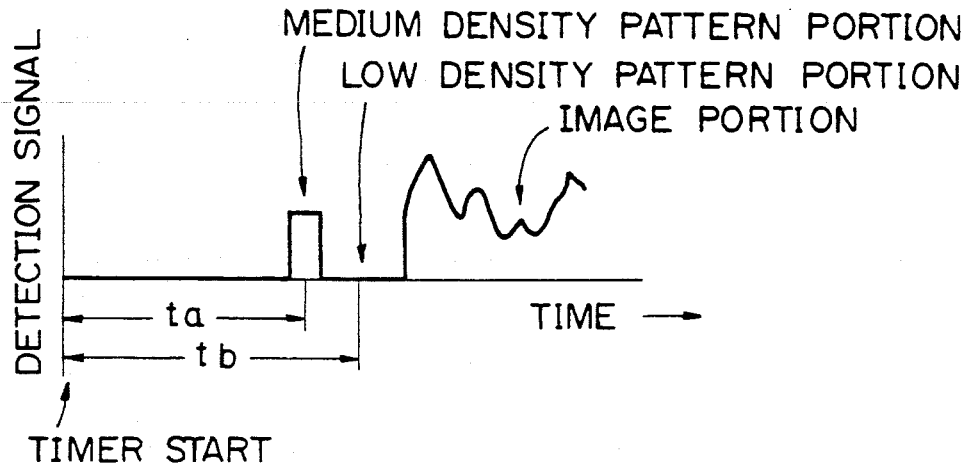
FIG. 7 is a timechart showing timing for obtaining density pattern signals.

Referring to FIG. 6, in a steps, the microcomputer judges whether or not a predetermined time period $t_a$ is elapsed after a timer provided in the CPU66 starts the counting operation. In other words, whether or not the position of the toner image of the medium density pattern 52*a* is opposed to the photoelectric sensor 54, is judged. If "YES", namely if $t_a$ was elapsed, the program proceeds to a step $S_2$. In the step $S_2$, the microcomputer receives the digital signal from the A/D converter 76 and stores the received signal in the RAM70 as $D_m$. As shown in FIG. 7, the photoelectric sensor 54 outputs the detection signal corresponding to the medium density pattern portion when the time period $t_a$ is elapsed after the starting time of count operation by the timer which may be at the starting time of exposure operation.

In the next step $S_3$, the microcomputer judges whether or not a predetermined time period $t_b$ is elapsed after the starting time, namely whether the position of the toner image of the low density pattern 52*b* is opposed to the photoelectric sensor 54. Only when "YES", the program proceeds to a step $S_4$ wherein the digital signal from the A/D converter 76 is input and then stored in the RAM 70 as $D_e$.

Therefore, the stored values $D_m$ and $D_e$ represent the detected values of the deposited toner quantities on the medium and low density pattern images, respectively.

In the next step $S_5$, the microcomputer calculates ratio of $D_m/D_e$ and then stores the calculated ratio in the RAM 70 as data P. In the next step $S_6$, the microcomputer compares the stored value P with a reference value $P_r$ which is preliminarily stored in the ROM 68 by calculating $P-P_r$, and then stores the calculated value $P-P_r$ in the RAM 70 as $P_d$. In the last step $S_7$, the microcomputer compares the stored value $D_e$ with a reference value $D_r$ which is preliminarily stored in the ROM 68 by calculating $D_e-D_r$, and then stores the calculated value $D_e-D_r$ in the RAM 70 as $D_d$.

Figure 8:
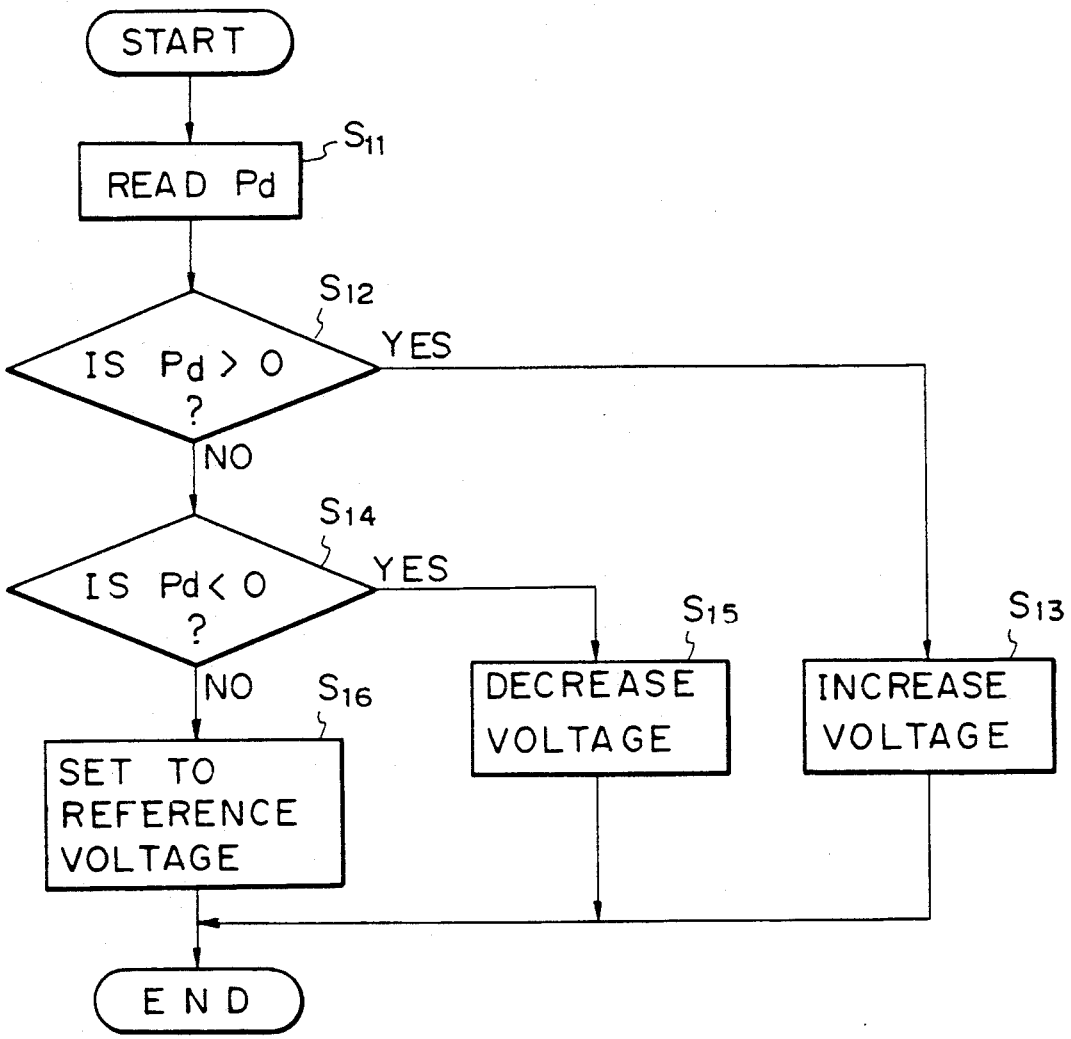

A program shown in FIG. 8 is executed before each exposure operation. In a step $S_{11}$ of the program, the stored value $P_d$ is read out from the RAM 70. Then, in a step $S_{12}$, whether or not the value $P_d$ is greater than zero is judged. If "YES", the program proceeds to a step $S_{13}$ wherein a signal is output from the microcomputer to the exposure lamp driver 158 such that the voltage applied to the exposure lamp 44 is increased in accordance with the value $P_d$. If "NO" in the step $S_{12}$, the program proceeds to a step $S_{14}$ wherein whether or not the value $P_d$ is smaller than zero is judged. If "YES" in the step $S_{14}$, the program proceeds to a step $S_{15}$ wherein a signal is applied to the exposure lamp driver 158 so that the voltage applied to the exposure lamp 44 is decreased in accordance with the value $P_d$. If "NO" in the step $S_{14}$, the program proceeds to a step $S_{16}$ wherein a reference voltage is applied to the exposure lamp 44.

According to the program of FIG. 8, when $P_d>0$, namely when the deposited toner quantity on the medium density pattern image is too much, the exposure lamp voltage is increased causing the medium density of the image to be decreased, and vice versa. As is known, the discharged amount from the photosensitive drum caused by exposure increases when the amount of the exposing light increases.

Figure 9:
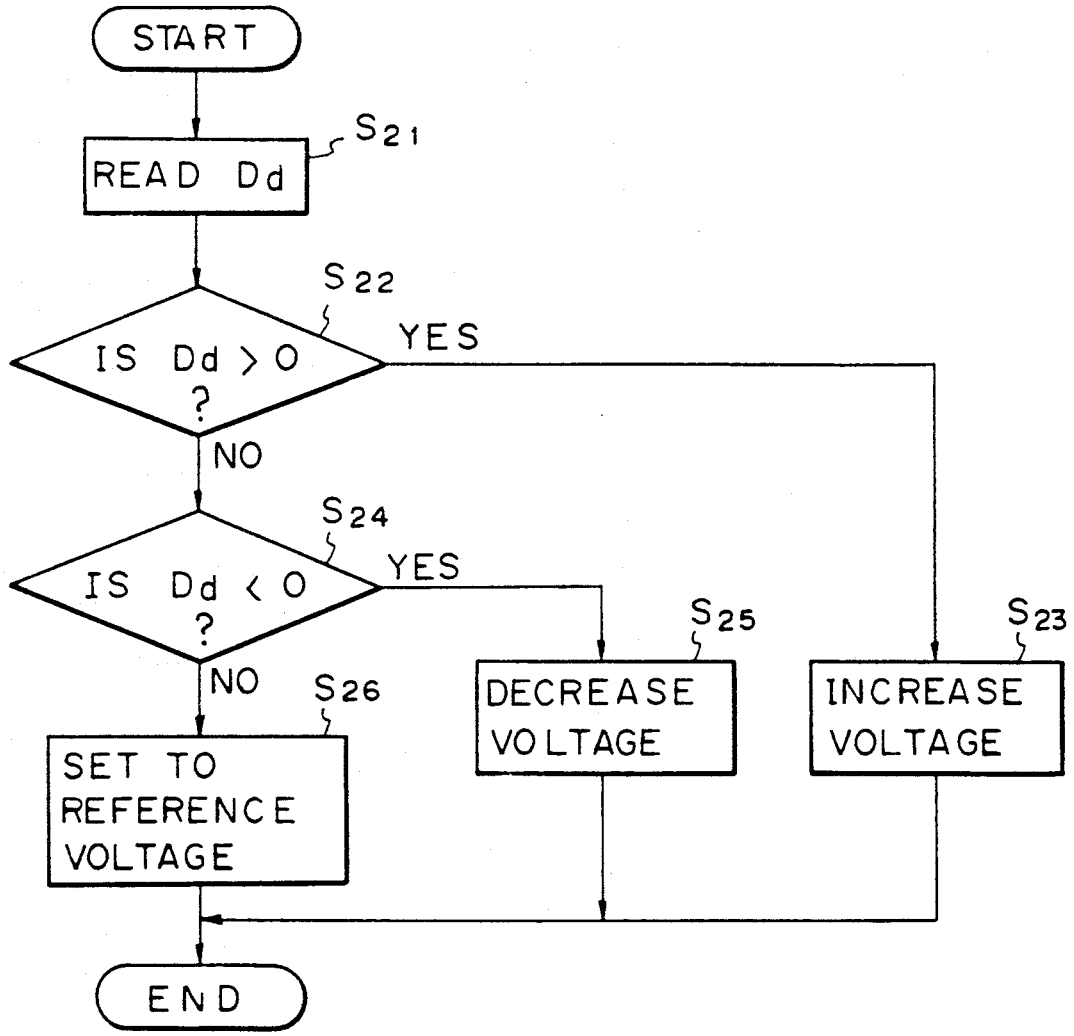

A program shown in FIG. 9 is executed before application of the developing bias voltage. In a step $S_2$, of the program, the stored value $D_d$ is read out from the RAM 70. Then, in a step $S_{22}$, whether or not the value $D_d$ is greater than zero is judged. If "YES", the program proceeds to a step $S_{23}$ wherein a signal is output from the microcomputer to the developing bias circuit 160 so that the developing bias voltage is increased in accordance with the value $D_d$. If "NO" in the step $S_{22}$, the program proceeds to a step $S_{24}$ wherein whether or not the value $D_d$ is smaller than zero is judged. If "YES" in the step $S_{24}$, the program proceeds to a step $S_{25}$ wherein a signal is applied to the bias circuit 160 so as to decrease the developing bias voltage in accordance with the value $D_d$.

According to the program of FIG. 9, when $D_d>0$, namely when the deposited toner quantity on the low density pattern image is too much, the bias voltage is increased causing the deposited toner quantity to decrease, and vice versa. In theory, however, since the deposited toner quantity on the low (background) density image should be zero, there will be no occurrence of $Da_d<0$.

Figure 10:
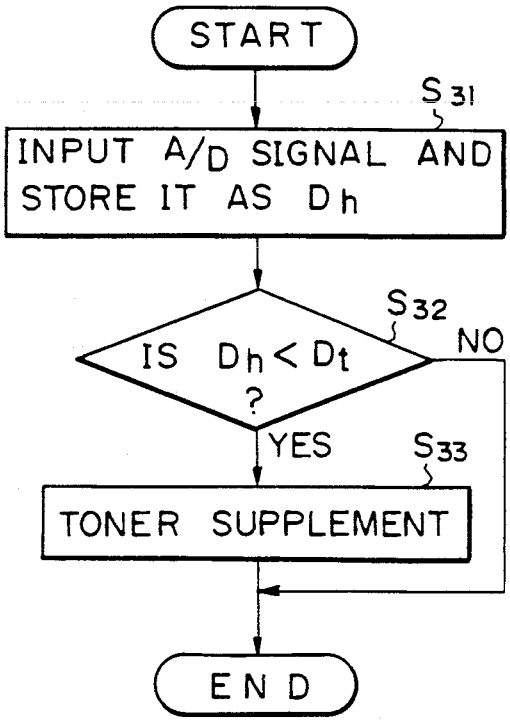
FIG. 8, 9 and 10 are flowcharts showing parts of microcomputer control programs used in the embodiment of FIG. 5.

The density of the high density portions of the image is controlled by the program shown in FIG. 10. In a step $S_{31}$ of the program, the digital signal from the A/D converter 78 is input to the microcomputer and stored in the RAM 70 as $D_h$. Then, in a step $S_{32}$, whether or not the stored value $D_h$ is smaller than a reference value $D_t$ which is preliminarily stored in the ROM 68 is judged. If "YES", the program proceeds to a step $S_{33}$ wherein a signal is output from the microcomputer to the toner supplementing driver 164 so as to supply more toner causing the toner density to increase. If "NO", no toner is supplemented.

Figure 11:
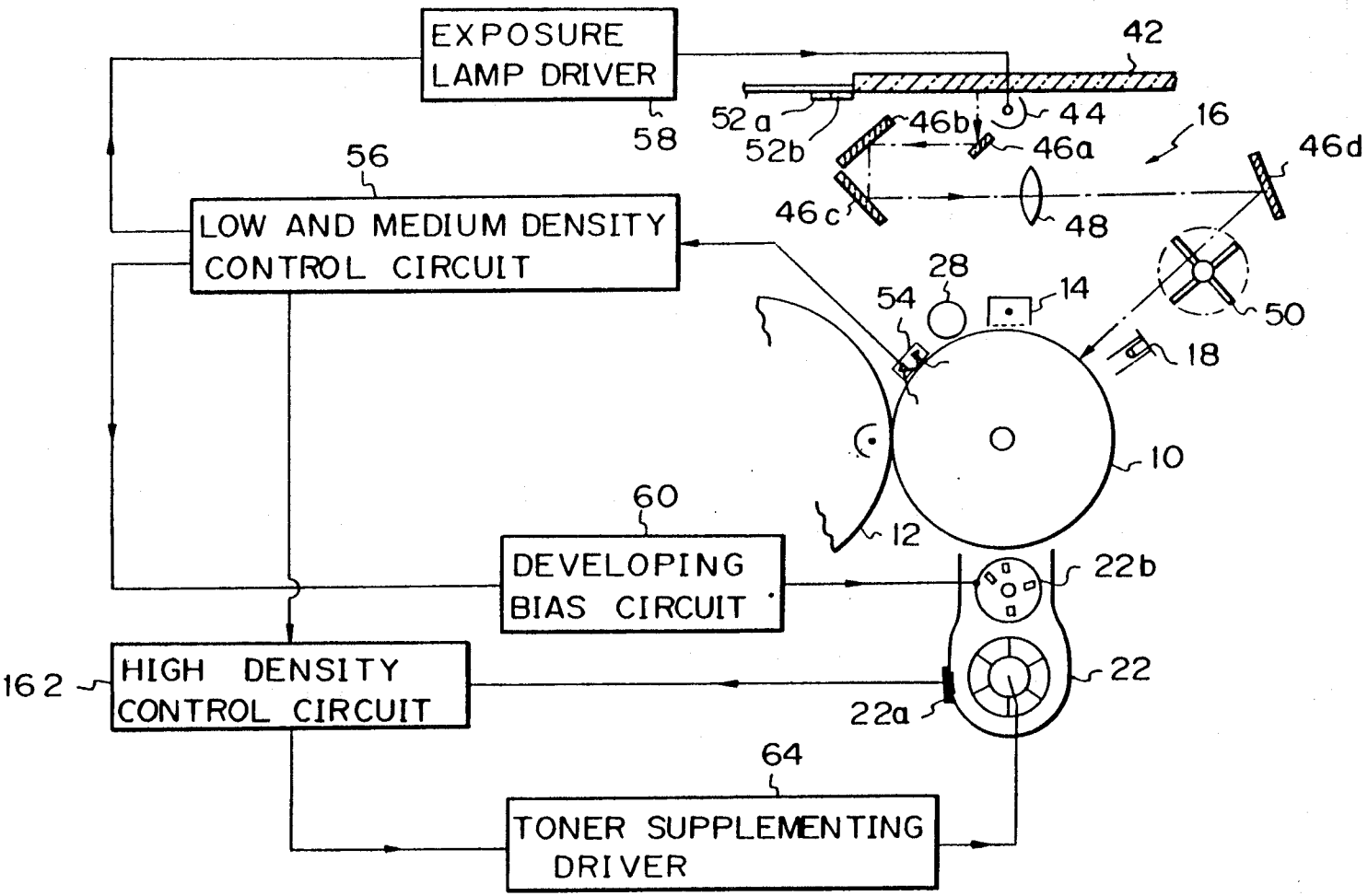
FIGS. 11 schematically illustrates an example of an image density control system in a further embodiment of the present invention.

FIG. 11 schematically illustrates an example of an image density control system of a further embodiment of the present invention. The particular embodiment is the same in structure as the embodiment of FIGS. 1 and 2 except for the image density control system.

In this embodiment, the output detection signal from the permeability sensor 22*a* and the output detection signal from the photoelectric sensor 54 are used to control the density of the high density portion of the image. The high density control circuit 162 includes a comparator which compares the output detection signal from the permeability sensor 22*a* with a reference value to determine whether the toner density is below a reference, and means which corrects the reference value in accordance with fluctuations of electric toner charges. A fluctuation of toner charges corresponds to variation of the ratio of the value of a detection signal indicative of the deposited quantity of toner on the low density pattern image to the value of a detection indicative of the deposited quantity of toner on the medium density pattern image, the ratio being calculated by the low and medium density control circuit 56.

Figure 12:
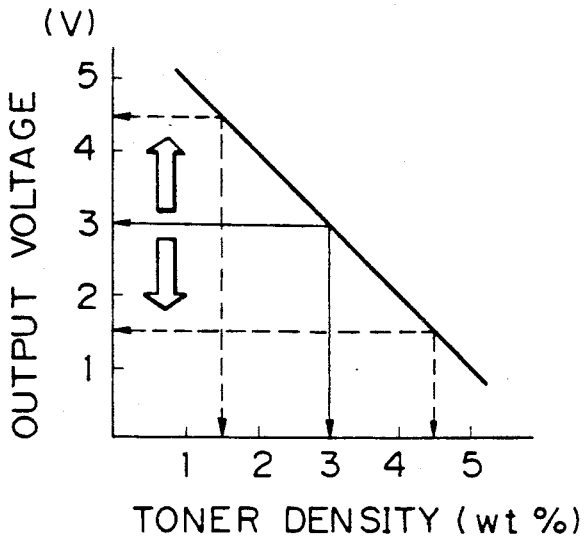
FIG. 12 shows the relationship between toner density and output voltage of a permeability sensor.

By correcting the reference value in accordance with fluctuation in the quantity of toner charges, the reference value for the toner density for the output voltage of detection signal (axis of ordinates) from the permeability sensor 22*a* is lowered and the toner density (axis of abscissas) is raised when the image density is low and the quantity of toner charges is large, as shown in FIG. 12. In contrast, when the image density is high and the quantity of toner charges is small, the reference value for the toner density for the output voltage from the permeability sensor 22*a* (axis of ordinates) is raised and the toner density (axis of abscissas) is lowered. It is desirable that a range in which the reference value for the toner density can be corrected should have a predetermined zone in order to avoid the formation of an abnormal image due to operational malfunction of the photoelectric sensor. The characteristics of the toner and developer, especially the quantity of toner charges, will fluctuate by ±20 to 30% depending on their environments of use and their aging. By such fluctuations of the characteristic of the developer, the image density will become high or low wholly even if the color balance is maintained. However, by correcting the reference value for the toner density, as mentioned above, the toner densities in the developing devices 20, 22, 24 and 26 for the respective colors are controlled such that the quantities of electric toner charges are maintained constant at all time. As a result, the density of the high density image portion is adjusted to an appropriate value and the overall density balance of the image is maintained satisfactory.

Figure 13:
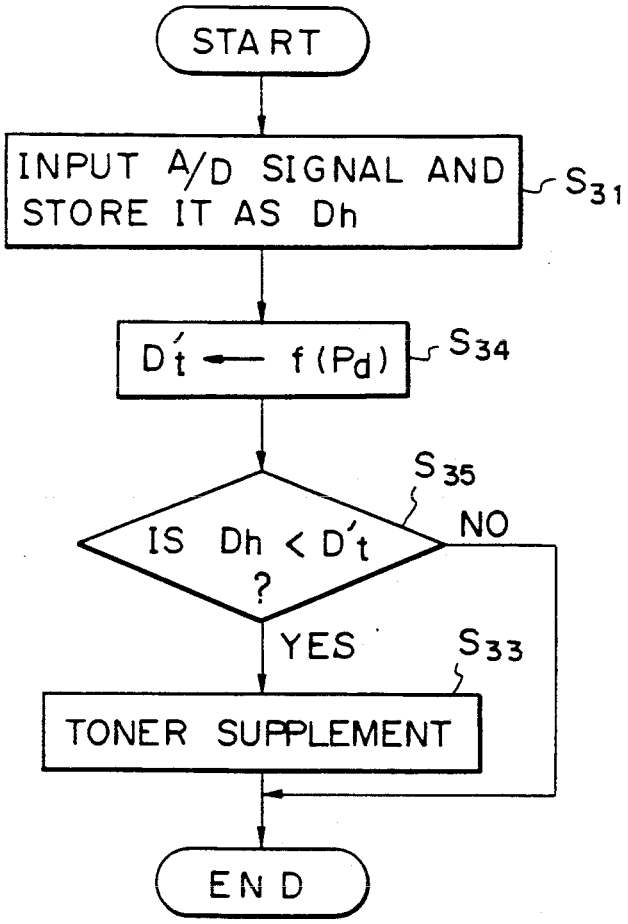
FIG. 13 is a flowchart showing part of a microcomputer control program used in a still further embodiment of the present invention.

FIG. 13 is a flowchart illustrating a control program for the microcomputer used in a further embodiment of the present invention. Since this embodiment is the same in mechanical structure as that of FIG. 5, its description will be omitted. Furthermore, the advantage of this embodiment is the same as that of the embodiment of FIG. 11. The program used in the FIG. 13 embodiment differs from the program shown in FIG. 10 in the following points. The program of FIG. 13 proceeds after the step $S_{31}$ to an additional step $S_{34}$ wherein a reference value $D_{t'}$ is corrected in accordance with the value $P_d$ calculated by the program of FIG. 6 and stored in the RAM 70. The correction is carried out so that the reference value $D_{t'}$ is increased when the value $P_d$ is large and vice versa. In the next step $S_{35}$, whether or not the stored value $D_h$ is smaller than the corrected reference value $D_{t'}$ is judged. Otherwise, operation of this program is the same as that of the program of FIG. 10.

In the above mentioned embodiment, the medium and low density patterns 52*a* and 52*b* are prepared in advance and exposed to light thereby to form latent images of medium and low densities on the photosensitive drum 10. Alternatively, in the present invention, latent images may be formed by directly controlling the potential of electric charges on a particular portion of the photosensitive drum 10. For example, the latent image of low density can be easily obtained by lowering the potential of the appropriate portion of the drum surface by the eraser 18 to the remaining potential.

While in the aforementioned embodiments the voltage applied to the exposure lamp 44 and the developing bias voltage are controlled to control the densities of the medium and low density portions of the image, the voltage applied to the charger 14 may be controlled instead.

Obviously, numerous additional modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. A color balance control method for use in an image forming system in which a full color image is formed by superposing toner images decomposed into three colors of yellow, magenta and cyan by means of an electrophotographic method, comprising the steps of:

correcting a supplement of toner in response to an output of a toner density sensor in a developing device;

forming unfixed toner images onto a photosensitive body for each color of the three colors, the unfixed toner images corresponding to each of a medium density reference image and a low density reference image, said low density reference image corresponding to a background potential of a photosensitive member, and said unfixed toner images corresponding to said low density reference image being influenced by a fluctuation of the background potential of a photosensitive member;

sensing the unfixed toner images for each color by means of a photoelectric sensor for sensing a deposited quantity of toner;

correcting exposure of scanning light onto an original document on the basis of a ratio of a sensed value of the medium density reference image to a sensed value of the low density reference image thereby to balance a medium density portion of color decomposed images for each color;

correcting developing bias voltage on the basis of the sensed value of the low density reference image thereby to balance a low density portion of the color decomposed images for each color; and correcting a reference value to be used in a correction for the supplement of toner on the basis of the sensed results of the sensing step.

2. A color balance control method according to claim 1, wherein said ratio of a sensed value of the medium density reference image to a sensed value of the low reference density image is compared with another reference value to correct the exposure of scanning light.

3. A color balance control method according to claim 1, wherein said sensed value of the low density reference image is compared with another reference value to correct said developing bias voltage.

4. A color balance control method according to claim 1, wherein the supplement of toner is corrected on the basis of the result of comparison between a detected toner density and said reference value.

5. A color balance control method according to claim 4, wherein said reference value is corrected according to the sensed result of the ratio of the low density reference image to the medium density reference image.

6. A color balance control method according to claim 4, wherein said reference value is corrected to adjust the quantity to be supplemented of the toner on the basis of the result of the comparison.

* * * * *